US008644117B2

(12) United States Patent
Matsuzaki et al.

(10) Patent No.: US 8,644,117 B2
(45) Date of Patent: Feb. 4, 2014

(54) ELECTRONIC TIMEPIECE

(75) Inventors: Jun Matsuzaki, Nagano-ken (JP); Norimitsu Baba, Nagano-ken (JP); Katsuyuki Honda, Nagano-ken (JP); Toshikazu Akiyama, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/597,858

(22) Filed: Aug. 29, 2012

(65) Prior Publication Data

US 2013/0051187 A1 Feb. 28, 2013

(30) Foreign Application Priority Data

Aug. 31, 2011 (JP) ..... 2011-188467

(51) Int. Cl.
*G04C 11/02* (2006.01)

(52) U.S. Cl.
USPC ..... 368/47

(58) Field of Classification Search
USPC ..... 368/46, 47, 64, 76, 14, 10, 13, 185, 55, 368/276, 278; 343/718, 702, 846, 848, 720
See application file for complete search history.

(56) References Cited

U.S. PATENT DOCUMENTS 4,287,597 A * 9/1981 Paynter et al. ..... 455/12.1
2010/0054087 A1 3/2010 Matsuzaki
2012/0243383 A1* 9/2012 Honda ..... 368/47

FOREIGN PATENT DOCUMENTS

JP 2010-060456 A 3/2010
JP 2012-002828 A 1/2012

* cited by examiner

*Primary Examiner* — Edwin A. Leon

(57) ABSTRACT

An electronic timepiece can improve the frequency of satellite signal reception and reduce power consumption. Such timepiece, e.g., a wristwatch has a GPS device that executes a reception process that locks onto a GPS satellite and receives satellite signals; a reception control unit that controls the reception process; and a solar panel that detects illuminance. The reception control unit includes an illuminance-based reception control unit that runs a reception process based on the detected illuminance, and a scheduled reception control unit that runs a reception process when a preset scheduled time is reached. The illuminance-based reception control unit stops reception when a satellite is not locked onto within a first locking time, and the scheduled reception control unit stops reception when a satellite is not locked onto in a second locking time that is shorter than the first locking time.

10 Claims, 8 Drawing Sheets

ELECTRONIC TIMEPIECE

CROSS REFERENCE TO RELATED APPLICATION

The entire disclosure of Japanese Patent Application No. 2011-188467, filed Aug. 31, 2011 is expressly incorporated by reference herein.

BACKGROUND

1. Technical Field

The present invention relates to an electronic timepiece that receives signals transmitted from GPS satellites or other positioning information satellites.

2. Related Art

GPS satellites with known orbits around the Earth are used in the GPS system, which is a system for determining one's position, and each GPS satellite carries an atomic clock. Each GPS satellite therefore also keeps extremely precise time information (also referred to as the GPS time or satellite time).

Electronic timepieces that use time information contained in navigation data sent from GPS satellites to correct internal time information kept by a timekeeping means are known from the literature. See, for example, Japanese Unexamined Patent Appl. Pub. JP-A-2010-60456.

JP-A-2010-60456 describes an electronic timepiece that in the reception process that receives satellite signals from GPS satellites first searches for a GPS satellite from which a satellite signal can be received, and then receives satellite signals from the GPS satellite that was locked onto by the search.

Executing the process that receives satellite signals from GPS satellites while indoors, however, is difficult. So that the reception process is executed while outdoors, configurations that provide the electronic timepiece with an illuminance detection means and execute the reception process when a specific illuminance is detected by the illuminance detection means are also conceivable.

However, when the reception process is executed based on the illuminance detected by such an illuminance detection means, the frequency of the reception process may drop because the electronic timepiece is covered by clothing during the winter, for example, and the specific illuminance therefore cannot be detected. The time is therefore adjusted less frequently in this case, and the accuracy of the time displayed by the electronic timepiece may drop.

Configurations that automatically run the reception process at a preset regular time when the reception process based on the illuminance detection process has not been executed for a specific time are also conceivable.

However, the electronic timepiece could be located indoors at the set time, and locking onto a GPS satellite may not be possible even though the reception process is executed. If the reception process continues in this case, not only can the satellite signal not be received, the reception process simply increases power consumption.

SUMMARY

An electronic timepiece according to the invention enables improving the frequency of satellite signal reception and decreasing power consumption.

One aspect of the invention is an electronic timepiece including: a reception unit that locks onto a positioning information satellite and receives satellite signals from the locked positioning information satellite; a time adjustment unit that adjusts internal time information based on the satellite signal received by the reception unit; a time display unit that displays the internal time information; an illuminance detection unit that detects illuminance; and a reception control unit that controls the reception unit, and includes an illuminance-based reception control unit that controls the reception unit and executes a satellite signal reception process when the illuminance detected by the illuminance detection unit equals or exceeds a specific illuminance threshold, and a scheduled reception control unit that controls the reception unit and executes a satellite signal reception process when the internal time information reaches a preset set time. The illuminance-based reception control unit stops the reception process when a positioning information satellite cannot be locked onto within a first locking time when the reception unit is controlled and the reception process started; and the scheduled reception control unit stops the reception process when a positioning information satellite cannot be locked onto within a second locking time that is shorter than the first locking time when the reception unit is controlled and the reception process started.

In this aspect of the invention the reception control unit has an illuminance-based reception control unit and a scheduled reception control unit. The illuminance-based reception control unit runs a process that controls the reception unit and receives satellite signals when the light to which the electronic timepiece is exposed and is detected by the illuminance detection unit equals or exceeds a specific threshold. When the internal time information reaches a preset set time, the scheduled reception control unit runs a process that controls the reception unit and receives satellite signals.

When the electronic timepiece is located indoors or the electronic timepiece is covered by clothing during the winter, for example, the amount of light detected by the illuminance detection unit will decrease to less than the specific illuminance threshold. In this case the reception process is not run by the illuminance-based reception control unit. As a result, the frequency of satellite signal reception drops and the frequency of adjusting the internal time according to a satellite signal drops.

However, in addition to the illuminance-based reception control unit, the invention also has a scheduled reception control unit that runs the reception process at a set time. As a result, the reception process can be run with the scheduled reception control unit when the reception process cannot be executed based on the detected illuminance. The frequency of satellite signal reception can therefore be improved, the time adjusted more frequently, and a drop in the accuracy of the displayed time can be suppressed.

To receive satellite signals, a process that locks onto (searches for) a positioning information satellite is performed first, and the locking process stops (times out) when a positioning information satellite cannot be locked within a specific time.

The illuminance-based reception control unit therefore controls the reception unit when the detected illuminance is greater than or equal to a specific threshold, that is, when the possibility of being outdoors is high. Therefore, while reception sensitivity may drop when the person wearing the wristwatch moves between buildings, for example, the probability of success in the locking process of the reception unit can be improved by setting the first locking time, which is the time until operation times out, to a long time of approximately 10 seconds, for example.

When the reception unit is controlled by the scheduled reception control unit, however, whether or not the electronic timepiece is outdoors is unclear. The reception process may therefore be performed while indoors, and if the locking process continues in this case, power consumption increases without being able to lock onto a positioning information satellite. Battery power can therefore drop and the duration time of the power supply be shortened in a battery-powered electronic timepiece such as a wristwatch.

Therefore, when the reception unit is controlled by the scheduled reception control unit, this aspect of the invention sets the second locking time until operation times out to a short time, such as 5 seconds, that is shorter than the first locking time until operation times out when the reception unit is controlled by the illuminance-based reception control unit. As a result, the locking process can be stopped more quickly when the locking process cannot lock onto a satellite signal during control by the scheduled reception control unit, and an increase in power consumption can be suppressed.

The invention can therefore improve the frequency of satellite signal reception and reduce power consumption.

Further preferably in an electronic timepiece according to another aspect of the invention, the reception control unit can select a first reception mode that operates the illuminance-based reception control unit and stops the scheduled reception control unit, and a second reception mode that operates the illuminance-based reception control unit and the scheduled reception control unit; switches control to the second reception mode when the reception process is not started within a specific time after starting control in the first reception mode; and stops the scheduled reception control unit when the reception process is started by the illuminance-based reception control unit after control is started in the second reception mode.

In this aspect of the invention only the illuminance-based reception control unit operates in the first reception mode. Therefore, if the reception control unit starts reception in the first reception mode, the reception process is executed only when a specific illuminance is detected, that is, when outdoors, and the probability of reception succeeding can be improved. Increased power consumption can therefore be prevented because the reception process does not run needlessly, such as when reception is attempted indoors.

Furthermore, because the second reception mode is selected when the reception process is not started for a specific time in the first reception mode, the frequency of reception can be increased because the reception process is started by the scheduled reception control unit at the scheduled time even if the specific illuminance is not detected.

Further preferably in an electronic timepiece according to another aspect of the invention, the reception control unit continues control in the second reception mode when the reception process by the scheduled reception control unit is started after control starts in the second reception mode and the reception process is then stopped because a positioning information satellite cannot be locked onto within the second locking time.

When the reception process is started by the scheduled reception control unit but a positioning information satellite cannot be locked onto within the second locking time, this aspect of the invention stops the reception process. Because this second locking time is shorter than the first locking time, power consumption by the reception process during this time is little. Control in the second reception mode can therefore be continued.

If control continues in the second reception mode, satellite signals can be received and the time can be adjusted more frequently, and the accuracy of the time displayed by the timepiece can be improved.

Further preferably in an electronic timepiece according to another aspect of the invention, the reception control unit switches control to the first reception mode when the process that stops the reception process because a positioning information satellite cannot be locked onto within the second locking time is consecutively executed at least a specific number of times.

Because the reception process of the scheduled reception control unit runs at a set time, when the reception process fails to lock onto a positioning information satellite a specific consecutive number of times, the electronic timepiece can be determined to not be outdoors at that set time. For example, even if the user of the electronic timepiece sets the time when the user is usually commuting and the user is usually outdoors as the scheduled reception time, the electronic timepiece may not be outdoors at the set time if the user's daily schedule changes. In this case, the possibility that the electronic timepiece will be outdoors the next time the set time arrives is low, and running the reception process at that set time simply increases power consumption.

Therefore, when the positioning information satellite locking process fails consecutively a specific number of times in the reception process controlled by the scheduled reception control unit, the reception control unit switches to the first reception mode and operates only the illuminance-based reception control unit. The number of times the reception process runs wastefully at the set time can therefore be reduced, and energy conservation can be improved.

Further preferably, an electronic timepiece according to another aspect of the invention also has a battery that supplies power to drive the electronic timepiece; and a voltage detection unit that detects the battery voltage. When the reception process is executed by the illuminance-based reception control unit during control in the first reception mode, when the reception process is executed by the illuminance-based reception control unit during control in the second reception mode, and when the reception process is started by the scheduled reception control unit and the positioning information satellite is locked within the second locking time during control in the second reception mode, the reception control unit detects the battery voltage with the voltage detection unit, delays reception control for a set rest period when the detected voltage is less than a specific threshold, and controls operation in the first reception mode without delaying reception control when the detected voltage is greater than or equal to the specific threshold.

When the reception process is run by the illuminance-based reception control unit, power is consumed whether or not the reception process succeeds or fails. Reception failures include being unable to lock onto a positioning information satellite in the first locking time, but because the first locking time is longer than the second locking time, power consumption also increases accordingly.

Power consumption is also low when a positioning information satellite cannot be locked onto in the second locking time when the reception process is run by the scheduled reception control unit, but when a positioning information satellite is locked onto and the satellite signal reception process is executed, power consumption increases whether reception succeeds or fails.

A large amount of power is therefore consumed in the reception process once the reception process starts except when a satellite cannot be locked onto in the second locking time. As a result, the reception process is delayed for a specific rest (delay) period (such as two days) when the battery voltage is detected and the battery voltage is less than a specific threshold level. Power consumption during this delay period is therefore reduced and the battery voltage can be increased by charging the battery during this time. However, if the battery voltage is greater than or equal to the specific threshold, control continues in the first reception mode, and power consumption can be suppressed by running the reception process only when the timepiece is determined to be outdoors.

An electronic timepiece according to another aspect of the invention preferably also has a battery that supplies power to drive the electronic timepiece; and a voltage detection unit that detects the battery voltage; and the scheduled reception control unit sets the second locking time according to the voltage detected by the voltage detection unit.

When the battery voltage is less than a specific voltage, the scheduled reception control unit sets the second locking time to a shorter time than when the battery voltage exceeds the specific voltage. If the positioning information satellite locking process of the reception unit continues for a long time and the remaining battery power is low, the battery voltage could drop below the required operating voltage of the semiconductor chips. The invention therefore suppresses how much the battery voltage drops relative to the remaining battery voltage when the battery voltage is low by shortening the time until the locking process times out.

An electronic timepiece according to another aspect of the invention preferably also has a scheduled time setting unit that sets the set time, and sets the time that the reception process of the illuminance-based reception control unit succeeded as the set time.

The time when the timepiece is outdoors, such as when commuting or going to lunch, is generally determined by the user's daily schedule. Therefore, by detecting the illuminance with an illuminance detection unit and setting the time when the reception process of the illuminance-based reception control unit succeeds as the set time for reception, a time when the user normally goes outdoors can be set as the set time. The possibility that the reception process can be executed outdoors where the reception environment is good can therefore be increased, and the probability that a satellite signal can be received can be improved, by running the reception process of the scheduled reception control unit at this set time.

Further preferably in an electronic timepiece according to another aspect of the invention, the scheduled reception control unit controls the reception unit and executes the positioning information satellite locking process at least one of a specific time before the set time and a specific time after the set time, stops the locking process when a positioning information satellite cannot be locked onto during the locking process within a third locking time that is shorter than the second locking time, and receives the satellite signal from the locked positioning information satellite when a positioning information satellite can be locked during the locking process.

In addition to the set time, the scheduled reception control unit in this aspect of the invention controls the reception unit and executes the satellite locking process at a specific time before the set time or a specific time after the set time. When the user's daily schedule changes slightly and the electronic timepiece is not outdoors at the set time, this aspect of the invention can lock onto a positioning information satellite in a locking process executed before or after the set time. The time adjustment unit can adjust the time in this case by receiving satellite signals from the locked positioning information satellite.

The time until operation times out in the locking process before or after the set time is set to a third locking time that is shorter than the second locking time. Increased power consumption by the locking process executed before or after the set time can therefore be suppressed.

When the scheduled reception control unit locks a positioning information satellite at the specific time before the set time and receives the satellite signal, the reception process does not need to be executed again at the following set time or the specific time after the set time. Likewise, when the satellite signal is received in the reception process at the set time, the reception process does not need to be executed again at the specific time after the set time.

An electronic timepiece according to another aspect of the invention preferably also has an illuminance-based reception date/time memory that stores the date and time the reception process is executed by the illuminance-based reception control unit, and the reception control unit stops the scheduled reception control unit when the date and time of the internal time information is a date and time that is at least a preset reception-enabled period past the date and time stored in the illuminance-based reception date/time memory.

When the reception process is not run by the illuminance-based reception control unit for a long time, the electronic timepiece has generally been left indoors. Running the reception process controlled by the scheduled reception control unit in this case will likely simply increase power consumption without being able to lock onto a positioning information satellite.

The invention therefore stores the date and time the reception process was executed by the illuminance-based reception control unit in an illuminance-based reception date/time memory unit, and when a specific reception-enabled period or more has past from the last date and time stored in the illuminance-based reception date/time memory, the reception control unit stops and does not operate the scheduled reception control unit, and operates only the illuminance-based reception control unit. As a result, when the electronic timepiece is left continuously indoors, the reception process is not run by the scheduled reception control unit, wasting power consumption by that reception process can be prevented, and energy conservation can be improved.

An electronic timepiece according to another aspect of the invention preferably also has a level detection unit that detects the signal level of the satellite signal received by the reception unit, and the illuminance-based reception control unit and the scheduled reception control unit stop the reception process when the signal level detected by the level detection unit goes below a specific threshold level during the reception process.

The person wearing the electronic timepiece could go indoors or enter a tunnel where the satellite signal reception environment is poor while the reception process is executing. If the reception process continues in this case, power will be consumed even though a satellite signal cannot be received.

The invention therefore stops the reception process when the signal level of the satellite signal detected by the level detection unit goes below a specific threshold during the reception process. The reception process can therefore be stopped quickly when the satellite signal reception environment becomes poor, and increased power consumption can be suppressed.

Note that the signal level detection process of the level detection unit could run continuously during the reception process or at a specific interval. If run continuously, change in the signal level can be detected in real time, and deterioration of the reception environment can be quickly detected. If the signal level is detected at a regular interval, power consumption by the level detection process can be suppressed.

DESCRIPTION OF EMBODIMENTS

A first embodiment of the invention is described below with reference to the accompanying figures.

Configuration of an Electronic Timepiece

Figure 1:
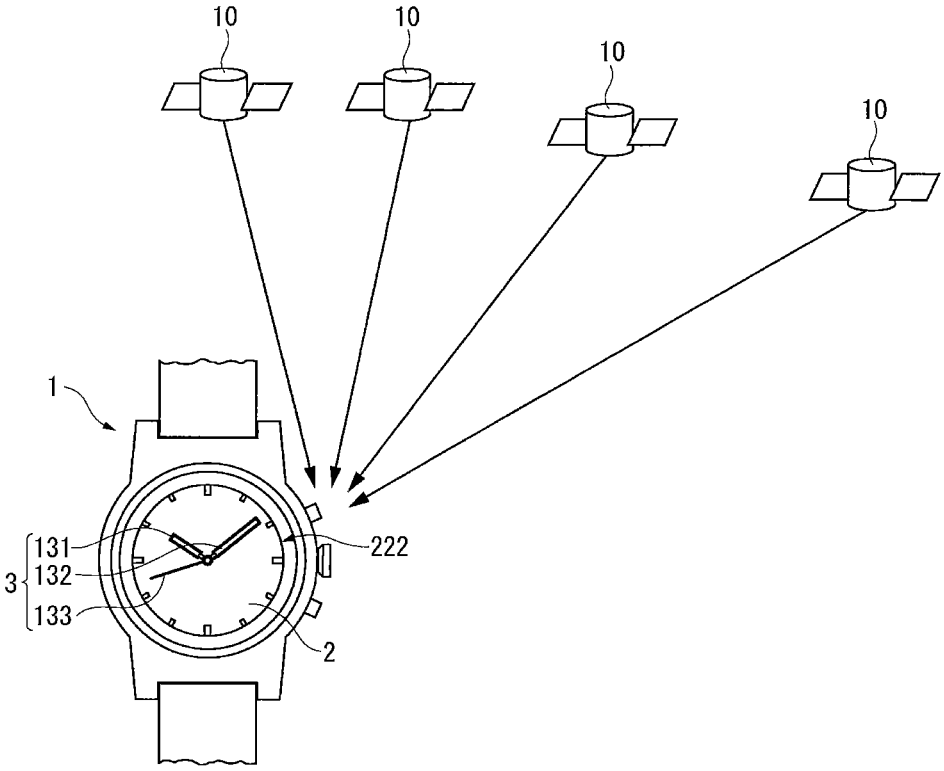
FIG. 1 shows a wristwatch according to a first embodiment of the invention.
Figure 2:
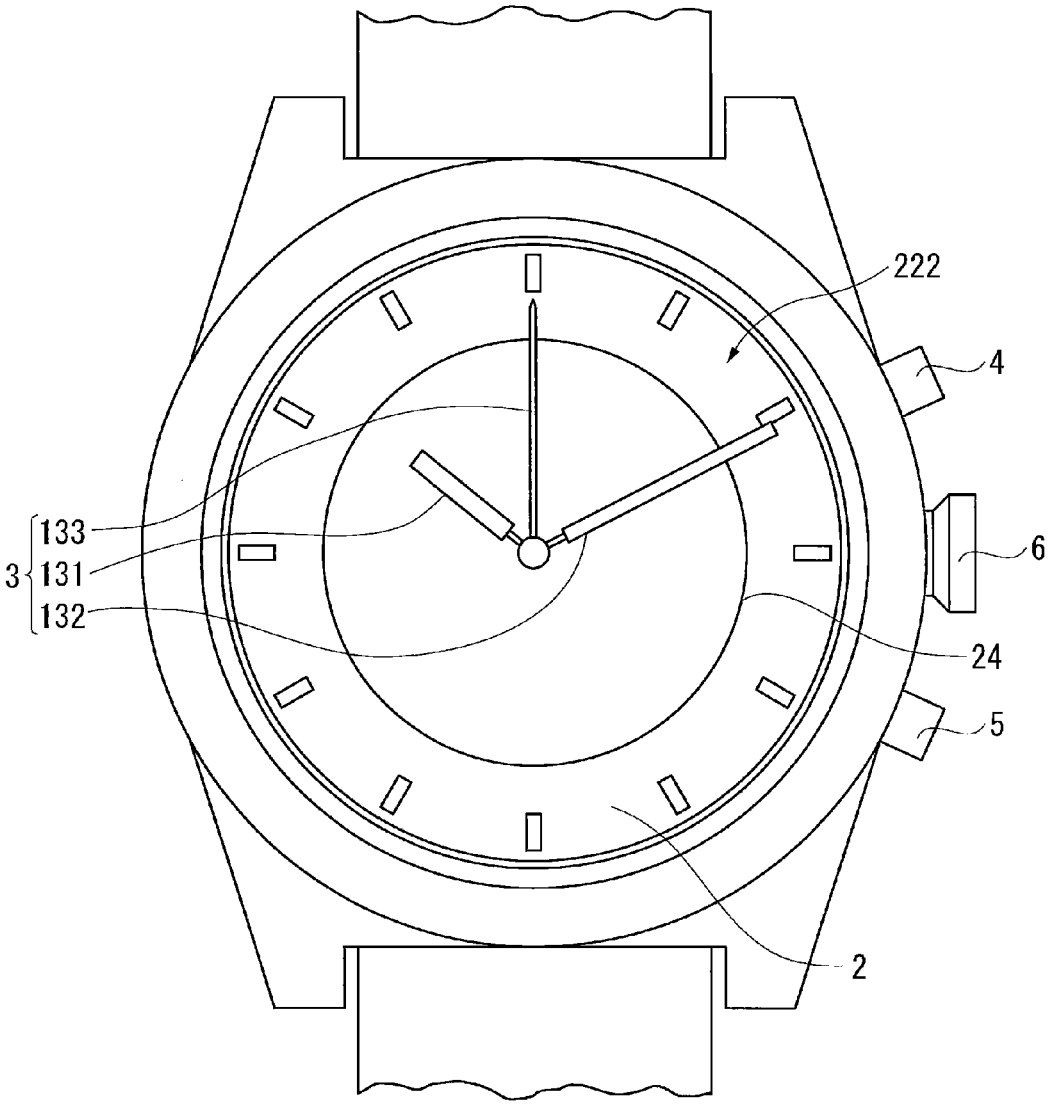
FIG. 2 shows the face of the wristwatch according to the first embodiment of the invention.

FIG. 1 shows a wristwatch with a GPS time adjustment device 1 (referred to as simply a "wristwatch 1" below) as an example of an electronic timepiece according to the invention, and FIG. 2 shows the face of the wristwatch 1.

As shown in FIG. 1, the wristwatch 1 is configured to receive satellite signals and acquire satellite time information from at least one GPS satellite 10 from among a plurality of GPS satellites 10 orbiting the Earth in space on specific orbits, and adjust time information that is kept internally (internal time information or simply the internal time). Note that a GPS satellite 10 is one example of a positioning information satellite as used in this invention, and plural satellites are currently in orbit. Approximately 30 GPS satellites 10 are currently in orbit.

FIG. 2 is a plan view showing the appearance of a wristwatch 1 according to this embodiment.

As shown in FIG. 2, this wristwatch 1 has a time display unit 222 including a dial 2 and hands 3, and buttons 4 and 5, and a crown 6. The hands 3 include an hour hand 131, minute hand 132, and second hand 133, and the hands 3 are driven through a wheel train by a stepper motor, for example.

The buttons 4 and 5 and crown 6 are external operating members for manually operating the wristwatch 1. More specifically, the displayed time is adjusted by operating the crown 6. When button 4 is pressed for a long time (such as 3 seconds or more), the reception process that receives satellite signals is executed.

When button 5 is pressed, a selection process that changes the reception mode (between a time acquisition mode and positioning mode) is executed.

In addition to the manual reception process initiated by operating the button 4, the wristwatch 1 also executes automatic reception processes that receive satellite signals automatically. These automatic reception processes include an illuminance-based automatic reception process that receives signals automatically when illuminance exceeding a specific level is received by the solar panel 24 disposed over the dial 2, and a scheduled automatic reception process that receives signals automatically at a set time.

Wristwatch Circuits

The main circuits of the wristwatch 1 are described next.

Figure 3:
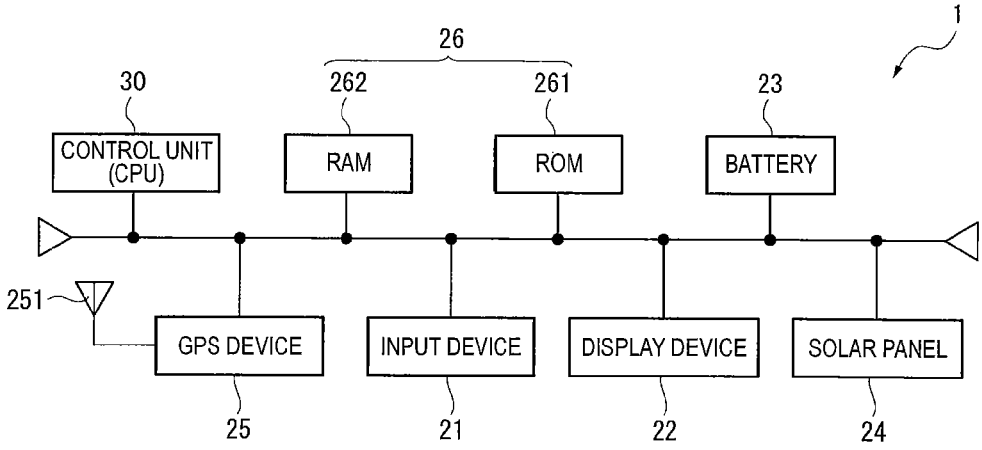
FIG. 3 describes the main hardware configuration of the wristwatch according to the first embodiment of the invention.
Figure 4:
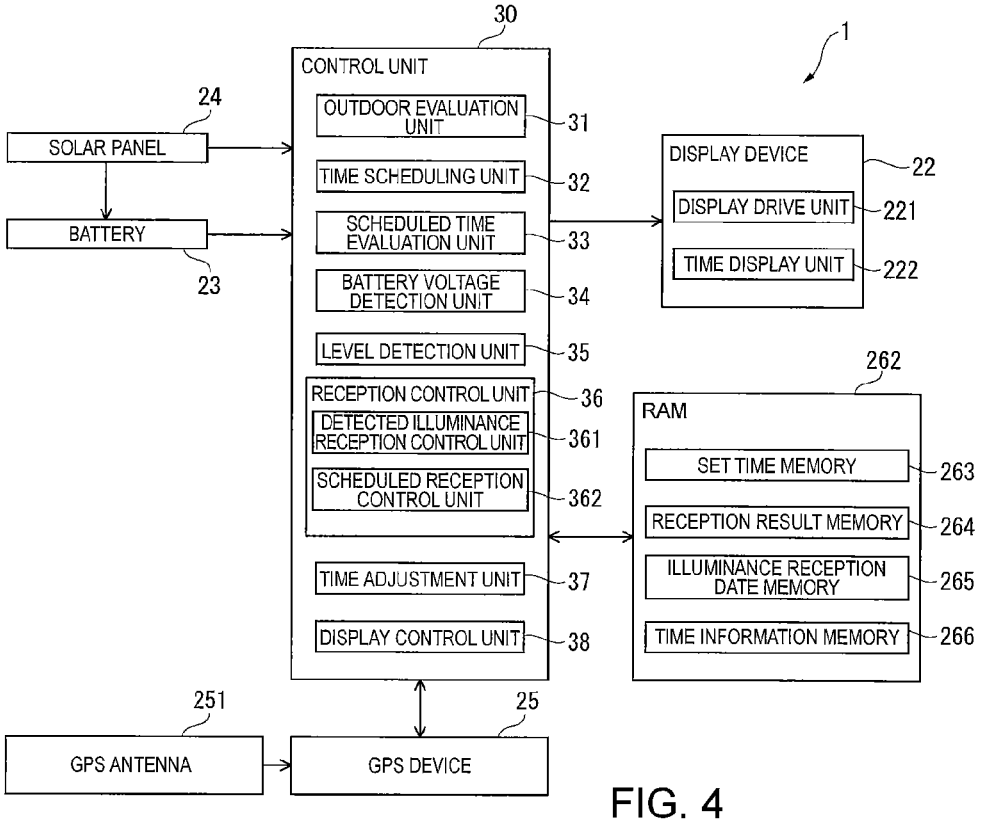
FIG. 4 is a block diagram of the main system configuration of the wristwatch according to the first embodiment of the invention.

FIG. 3 shows the main hardware configuration of the wristwatch 1. FIG. 4 is a function block diagram showing the configuration of the wristwatch 1.

As shown in FIG. 3, the wristwatch 1 includes an input device 21, display device 22, battery 23, solar panel 24 (illuminance detection unit), a GPS device 25 (reception unit), storage device 26, and control unit 30.

The input device 21 includes buttons 4 and 5 and the crown 6.

The display device 22 includes a display drive unit 221 and time display unit 222. The display drive unit 221 includes a stepper motor and wheel train for driving the hands 3. The display unit 222 includes the dial 2 and hands 3.

The battery 23 is a storage battery, and stores power produced by the solar panel 24. The battery 23 supplies power to parts of the wristwatch 1 including the display device 22, GPS device 25, storage device 26, and control unit 30.

The solar panel 24 has a photovoltaic device that produces power by converting light energy to electric energy. The solar panel 24 also outputs a detection signal to the control unit 30 based on the illuminance of the received light.

Configuration of the GPS Device

The GPS device 25 includes a GPS antenna 251. While not shown in the figures, the GPS device 25 includes an RF (radio frequency) unit that receives and converts satellite signals sent from the GPS satellites to digital signals; a baseband unit that performs a correlation process to synchronize with the received signals; and an information acquisition unit that acquires time information and positioning information from the navigation message (satellite signal) demodulated by the baseband unit.

The RF unit includes a bandpass filter, PLL circuit, IF filter, VCO (voltage controlled oscillator), A/D converter, mixer, LNA (low noise amplifier), and IF amplifier.

Satellite signals extracted by the bandpass filter are amplified by the LNA and mixed with the VCO signal by the mixer, and then down-converted to an IF (intermediate frequency) signal. The IF signal mixed by the mixer passes through an IF amplifier and IF filter, and is converted to a digital signal by the A/D converter.

The baseband unit includes a local code generator and a correlation unit. The local code generator generates a local code that is identical to the C/A code used by the GPS satellite for signal transmission. The correlation unit calculates the correlation between this local code and the reception signal output from the RF unit.

If the correlation value calculated by the correlation unit is greater than or equal to a specific threshold value, the local code matches the C/A code used in the received satellite signal, and locking onto (synchronization with) the satellite signal is possible. As a result, the navigation message can be demodulated by applying a correlation process to the received satellite signal using the local code.

The data acquisition unit acquires the time information and positioning information from the navigation message demodulated by the baseband unit. More specifically, the navigation messages sent from the GPS satellites include preamble data and the TOW (Time of Week, also called the Z count) of the HOW (Handover Word), and subframe data. The subframe data includes subframes 1 to 5, and each subframe contains, for example, satellite correction data such as the week number and satellite health data, ephemeris (detailed orbit information for a particular GPS satellite), and almanac data (orbit information for all GPS satellites).

The data acquisition unit extracts specific data from the received navigation message, and acquires the time information and positioning information.

Storage Device Configuration

The storage device 26 includes ROM 261 and RAM 262.

A program run by the control unit 30 is stored in ROM 261.

As shown in FIG. 4, the RAM 262 has a set time memory 263, locking result memory 264, illuminance-based reception date/time memory 265, and time information memory 266.

The set time memory 263 stores the time that is set for executing the scheduled automatic reception process.

The locking result memory 264 stores the locking result indicating if the satellite locking process succeeded when the locking process that locks onto a GPS satellite 10 (second locking process) is executed by the GPS device 25 in the scheduled automatic reception process. If the locking result of the second locking process is failure, and the locking result of the second locking process of the day before was also a failure, the number of times (number of days) locking failed consecutively is also stored.

The illuminance-based reception date/time memory 265 stores the date and time a satellite signal was received when satellite signals are received from a GPS satellite 10 and the time adjustment process is executed in the illuminance-based automatic reception process.

The time information memory 266 stores the time information contained in the satellite signals acquired by the reception process of the GPS device 25.

Control Unit Configuration

The control unit 30 controls the GPS device 25, and corrects the internal time information based on the time information contained in the acquired satellite signal.

The control unit 30 controls operation according to a program stored in ROM 261. As shown in FIG. 4, the control unit 30 therefore has an outdoor evaluation unit 31, time scheduling unit 32, scheduled time evaluation unit 33, battery voltage detection unit 34, level detection unit 35, reception control unit 36, time adjustment unit 37, and display control unit 38.

The outdoor evaluation unit 31 determines if the light received by the solar panel 24 equals or exceeds a specific illuminance level, and if the received illuminance exceeds this threshold determines that the wristwatch 1 is outdoors.

The time scheduling unit 32 sets the time at which the scheduled automatic reception process is executed. In this embodiment the time scheduling unit 32 sets the time stored in the illuminance-based reception date/time memory 265, that is, the time when the reception process was executed when the illuminance-based automatic reception process succeeds, as the time set for scheduled reception. The time scheduling unit 32 stores the set time in the set time memory 263.

The scheduled time evaluation unit 33 determines if the internal time kept by the wristwatch 1 has reached the set time stored in the set time memory 263.

The battery voltage detection unit 34 detects the voltage of the battery 23.

The level detection unit 35 detects the signal level of the satellite signal being received when satellite signals are being received by the GPS device 25.

The reception control unit 36 includes an illuminance-based reception control unit 361 that controls the GPS device 25 and runs the illuminance-based automatic reception process, and a scheduled reception control unit 362 that controls the GPS device 25 and runs the scheduled automatic reception process.

The illuminance-based reception control unit 361 runs the illuminance-based automatic reception process when the outdoor evaluation unit 31 determines that the wristwatch 1 is outdoors.

In the illuminance-based automatic reception process the illuminance-based reception control unit 361 first controls the GPS device 25 to execute the GPS satellite 10 locking process (first locking process). If locking onto a GPS satellite 10 is successful in this first locking process, the illuminance-based reception control unit 361 controls the GPS device 25 to execute the reception process (first reception process) that receives the satellite signal from the locked GPS satellite 10.

The illuminance-based automatic reception process of the illuminance-based reception control unit 361 is described in further detail below.

The scheduled reception control unit 362 executes the scheduled automatic reception process when the scheduled time evaluation unit 33 determines that the internal time has reached the set time stored in the set time memory 263.

In this scheduled automatic reception process the scheduled reception control unit 362 first controls the GPS device 25 to execute the GPS satellite 10 locking process (second locking process). If this second locking process successfully locks onto a GPS satellite 10, the scheduled reception control unit 362 controls the GPS device 25 to execute the reception process (second reception process) that receives the satellite signal from the locked GPS satellite 10.

The scheduled automatic reception process executed by the scheduled reception control unit 362 is described in further detail below.

The reception control unit 36 selects and controls operation in a first reception mode that operates only the illuminance-based reception control unit 361, or a second reception mode that operates both the illuminance-based reception control unit 361 and scheduled reception control unit 362.

The time adjustment unit 37 adjusts the internal time information based on the time information acquired by the GPS device 25 and stored in the time information memory 266.

The display control unit 38 drives the display drive unit 221 and displays the time with the time display unit 222 based on the time indicated by the internal time information.

Automatic Reception Process of the Wristwatch

The automatic reception process executed by the reception control unit is described next with reference to the flow charts in FIG. 5, FIG. 6, and FIG. 7.

Figure 5:
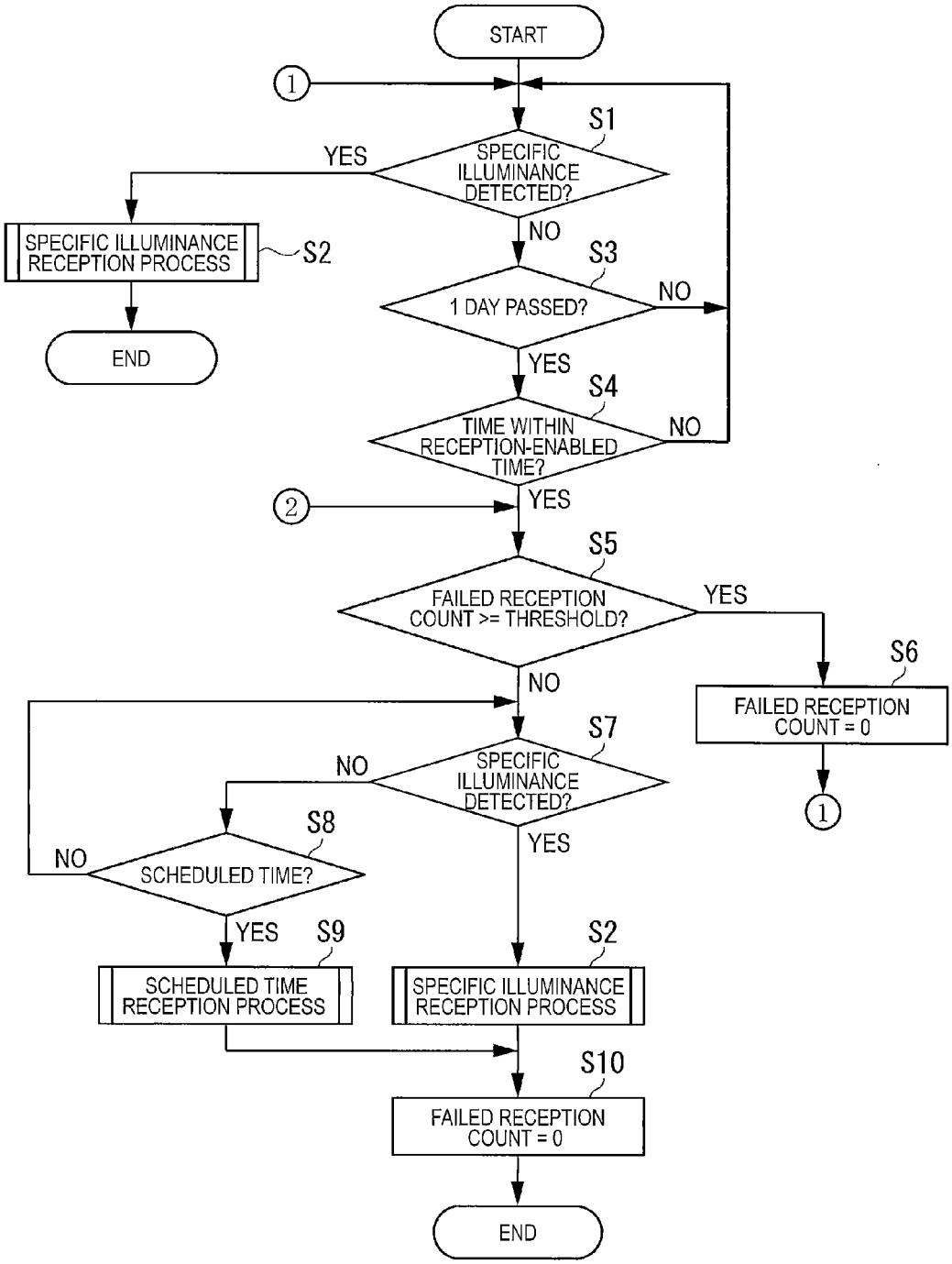
FIG. 5 is a flow chart of the automatic reception process in the wristwatch according to the first embodiment of the invention.

FIG. 5 is a flow chart of the automatic reception process executed by the control unit 30.

When the automatic reception process starts, the reception control unit 36 first controls operation in the first reception mode. As a result, the reception control unit 36 operates only the illuminance-based reception control unit 361.

Using the outdoor evaluation unit 31, the illuminance-based reception control unit 361 determines if the amount of light received by the solar panel 24 equals or exceeds a specific illuminance level (S1).

If S1 returns Yes, that is, if the light received by the solar panel 24 exceeds the specific threshold, the illuminance-based reception control unit 361 determines that the wristwatch 1 is outdoors.

In this case the illuminance-based reception control unit 361 executes the illuminance-based automatic reception process (S2).

Illuminance-Based Automatic Reception Process

Figure 6:
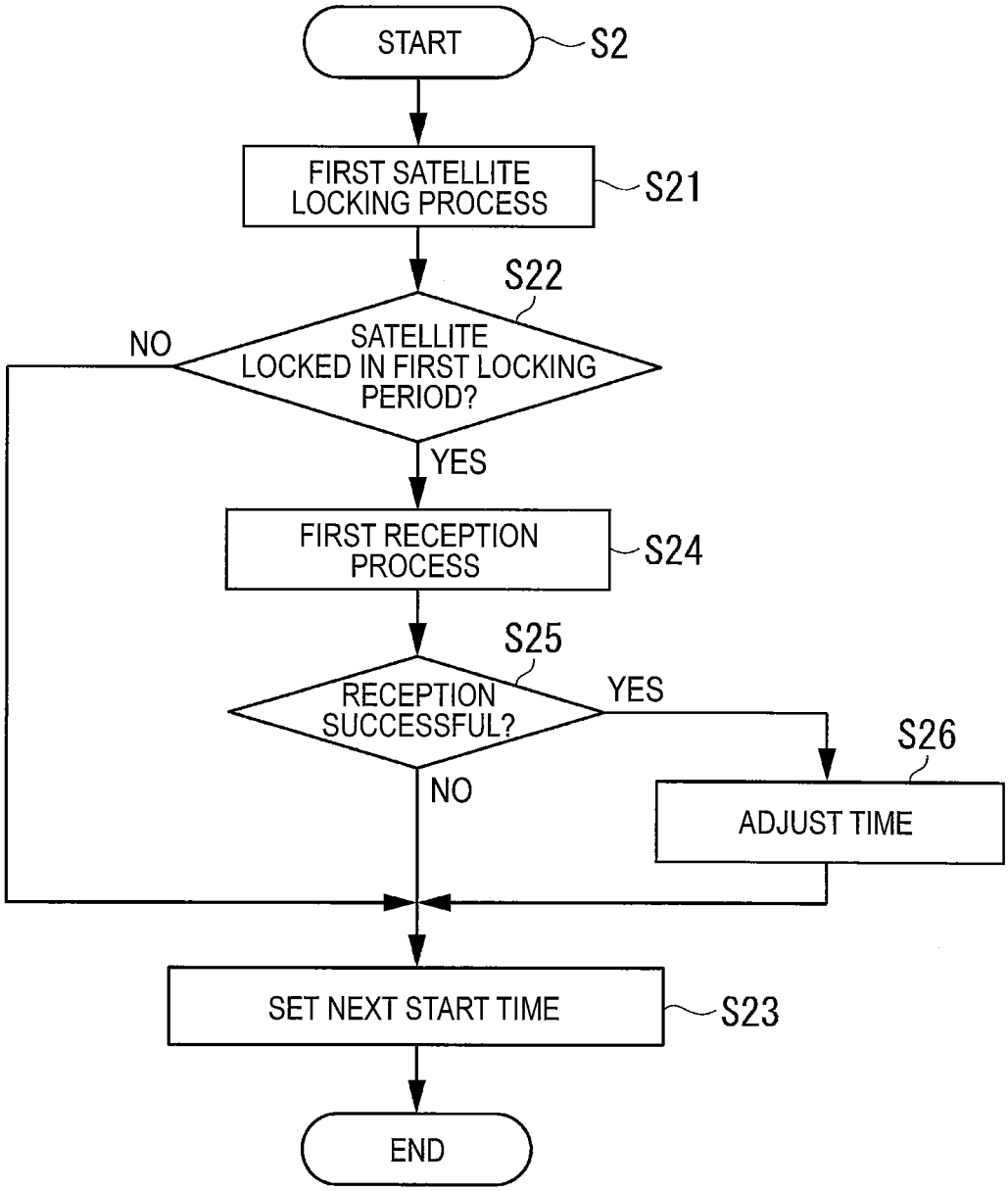
FIG. 6 is a flow chart of the illuminance detection based automatic reception process in a wristwatch according to the first embodiment of the invention.

FIG. 6 is a flow chart of the illuminance-based automatic reception process.

As shown in FIG. 6, in the illuminance-based automatic reception process of step S2, the illuminance-based reception control unit 361 controls the GPS device 25 to execute the first locking process to lock onto a GPS satellite 10 (S21).

The illuminance-based reception control unit 361 then determines if a GPS satellite 10 was locked within a predetermined first locking time in step S21 (S22).

This first locking time is set by reception tests based on detected illuminance to a time at which the probability of locking onto at least one GPS satellite 10 transmitting a signal with an SNR (signal-to-noise ratio) of 30 or more is sufficiently high. In this embodiment the first locking time is set to 8 seconds, the time at which the probability of being able to lock onto at least one GPS satellite 10 with an SNR of 30 or more was 95% or greater in the reception tests. Setting this first locking time prevents applying the locking process continuously for a long time to a GPS satellite 10 that cannot be locked onto, and therefore suppresses wasteful power consumption.

If S22 returns No, the reception control unit 36 determines that the reception process of the illuminance-based reception control unit 361 failed, and sets the start time for the next automatic reception process (S23). More specifically, based on the battery 23 voltage detected by the battery voltage detection unit 34, the reception control unit 36 sets the start time of the next automatic reception process to 00:00:00 a.m. the next day, for example, if the voltage is 3.9 V or greater. If the battery 23 voltage is less than 3.9 V, the reception control unit 36 sets the start time of the next automatic reception process to 00:00:00 a.m. three days later, for example, and sets a reception delay period of two days.

However, if S22 returns Yes, the illuminance-based reception control unit 361 executes the first reception process that receives a satellite signal from the locked GPS satellite 10 (S24), and determines if satellite signal reception was successful (S25). The illuminance-based reception control unit 361 determines reception was successful in the first reception process when a satellite signal is received within a preset specific time (such as 30 sec to 1 min). Reception is determined to have failed when a satellite signal could not be received within that specific time, and when the signal level of the satellite signal detected by the level detection unit 35 is less than a preset threshold level.

When reception is determined successful in S25, the illuminance-based reception control unit 361 stores the time information contained in the received satellite signal in the time information memory 266.

The time adjustment unit 37 then adjusts the internal time information based on the time information stored in the time information memory 266 (S26). In step S26 the illuminance-based reception control unit 361 also stores the date and time the first reception process was successful in the illuminance-based reception date/time memory 265. The time scheduling unit 32 stores the time the first reception process was successful in the set time memory 263.

The illuminance-based reception control unit 361 executes step S23 to set the start time of the next automatic reception process when S25 returns No and after the time is adjusted in S26.

After the illuminance-based automatic reception process is completed in step S2, the automatic reception process ends as shown in FIG. 5. The automatic reception process in step S1 is executed again when the internal time information reaches the start time of the automatic reception process set in step S23.

Referring again to FIG. 5, if the outdoor evaluation unit 31 returns No in S1, the reception control unit 36 determines based on the internal time information if one day has passed (S3).

If S3 returns No, the reception control unit 36 returns to S1 and continues monitoring the detected illuminance with the outdoor evaluation unit 31.

However, when S3 returns Yes, that is, the illuminance-based automatic reception process was not run on day 1, the reception control unit 36 determines if the current date and time indicated by the internal time information is within a specific reception-enabled period following the time when the illuminance-based automatic reception process was last executed (S4).

In step S4 the reception control unit 36 references the date and time stored in the illuminance-based reception date/time memory 265, and determines if the current date/time is within the reception-enabled period after the date/time stored in the illuminance-based reception date/time memory 265.

Control returns to S1 if No is returned in S4. More specifically, if No is returned in S4, the reception control unit 36 continues control in the first reception mode and operates only the illuminance-based reception control unit 361 because the wristwatch 1 has remained indoors for a long time.

However, if S4 returns yes, the reception control unit 36 determines if the locking failure count (number of days) of the scheduled automatic reception process is a specific count (number of days) or more (S5). This specific count is 3 (3 days) in this embodiment.

If S5 returns Yes, the reception control unit 36 resets the locking failure count stored in the locking result memory 264 to 0 (S6), and returns to S1. More specifically, if S5 returns Yes, the possibility that the wristwatch 1 is outdoors at the set time is low and the reception control unit 36 therefore controls operation in the first reception mode and operates only the illuminance-based reception control unit 361.

However, if S5 returns No, the reception control unit 36 controls operation in the second reception mode and operates both the illuminance-based reception control unit 361 and scheduled reception control unit 362.

In the second reception mode the illuminance-based reception control unit 361 determines if the light received by the solar panel 24 exceeds the specific threshold using the outdoor evaluation unit 31 (S7). If S7 returns Yes, the illuminance-based reception control unit 361 runs the illuminance-based automatic reception process in S2.

If S7 returns No, the scheduled reception control unit 362 uses the scheduled time evaluation unit 33 to determine if the time indicated by the internal time information has reached the set time stored in the set time memory 263 (S8).

If the scheduled time evaluation unit 33 returns No in S8, control returns to S7.

If S8 returns Yes, that is, the time of the internal time information has reached the set time, the scheduled reception control unit 362 executes the scheduled automatic reception process (S9).

Scheduled Automatic Reception Process

Figure 7:
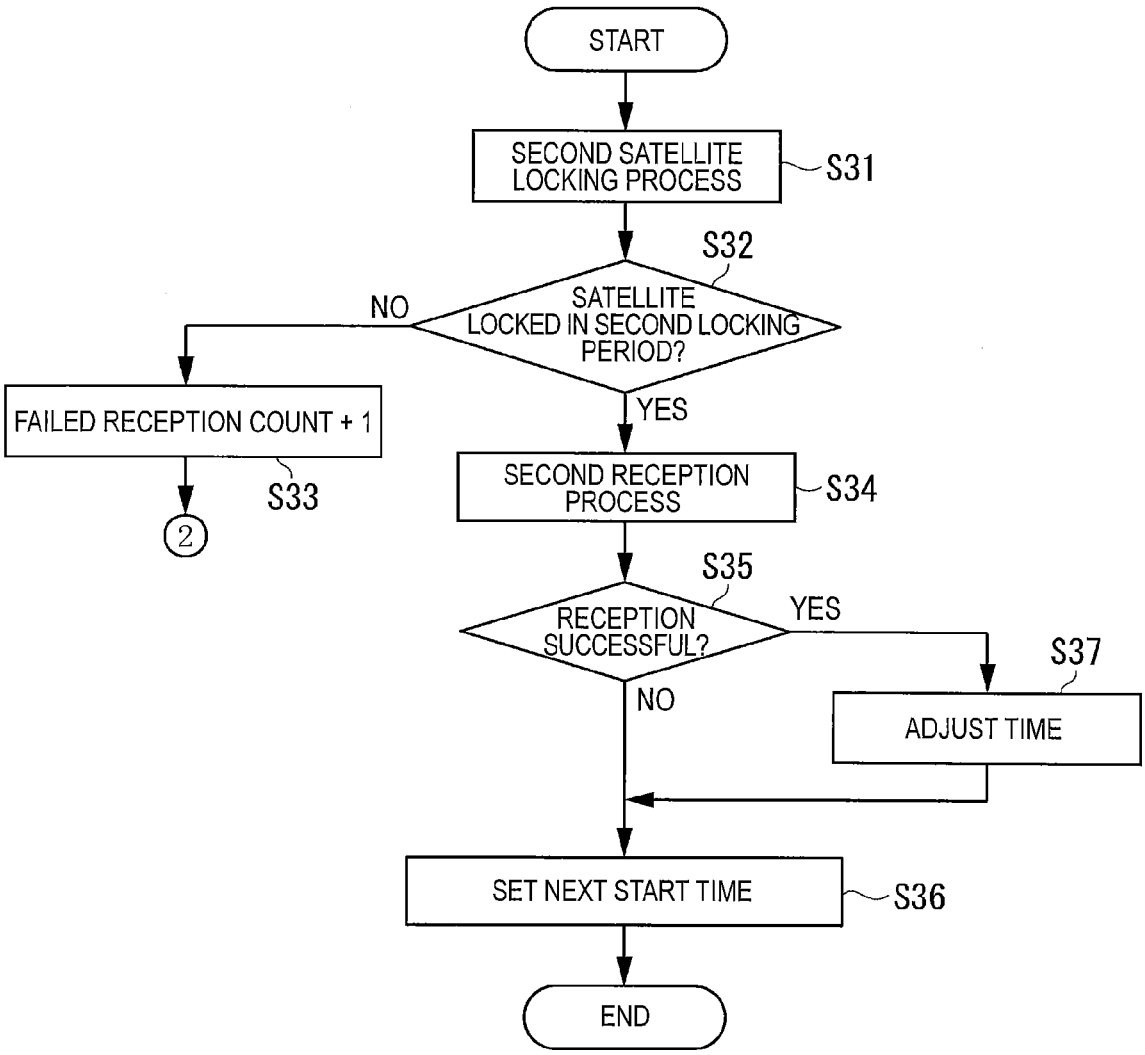
FIG. 7 is a flow chart of the scheduled automatic reception process in a wristwatch according to the first embodiment of the invention.

FIG. 7 is a flow chart of the scheduled automatic reception process.

In the scheduled automatic reception process of step S9 as shown in FIG. 7, the scheduled reception control unit 362 controls the GPS device 25 to execute the second locking process to lock onto a GPS satellite 10 (S31).

In S31 the scheduled reception control unit 362 determines if a GPS satellite 10 was locked during a preset second locking time (S32).

This second locking time is set to the time at which the probability of being able to lock onto at least one GPS satellite 10 transmitting a signal with an SNR of 30 or was 80% or more in the reception tests, and in this embodiment is set to 5 seconds. This second locking time is thus set to a shorter time than the first locking time. Setting such a second locking time enables suppressing power consumption even more than the locking process of the illuminance-based reception control unit 361.

If No is returned in S32, the reception control unit 36 adds 1 to the locking failure count stored in the locking result memory 264 (S33). The reception control unit 36 then returns to step S5 in FIG. 5.

However, if Yes is returned in S32, the scheduled reception control unit 362 executes the second reception process to receive the satellite signal sent from the locked GPS satellite 10 (S34), and then determines if satellite signal reception was successful (S35). The scheduled reception control unit 362 determines reception was successful in the second reception process when the satellite signal is received within a preset specific time (such as 30 sec to 1 min). Reception is determined to have failed when a satellite signal could not be received within that specific time, and when the signal level of the satellite signal detected by the level detection unit 35 is less than a preset threshold level.

When No is returned in S25, the reception control unit 36 determines the reception process of the scheduled reception control unit 362 failed, and sets the start time of the next automatic reception process (S36). More specifically, based on the battery 23 voltage detected by the battery voltage detection unit 34, the reception control unit 36 sets the start time of the next automatic reception process to 00:00:00 a.m. the next day, for example, if the voltage is 3.9 V or greater. If the battery 23 voltage is less than 3.9 V, the reception control unit 36 sets the start time of the next automatic reception process to 00:00:00 a.m. three days later, for example, and sets a reception delay period of two days.

If Yes is returned in S35, the scheduled reception control unit 362 stores the time information contained in the received satellite signal in the time information memory 266.

The time adjustment unit 37 then adjusts the internal time information based on the time information stored in the time information memory 266 (S37). After step S37, the reception control unit 36 goes to step S36 and sets the start time of the next automatic reception process.

After the scheduled automatic reception process in step S9 above, or after step S7 determines Yes and the illuminance-based automatic reception process is executed in step S2, the reception control unit 36 resets the locking failure count stored in the locking result memory 264 to 0 as shown in FIG. 5 (S10), and ends the automatic reception process. When the internal time information reaches the start time of the automatic reception process set in step S36, the reception control unit 36 starts the automatic reception process again and executes step S1.

Effect of the Embodiment

The wristwatch 1 according to this embodiment of the invention has reception control unit 36 that includes an illuminance-based reception control unit 361 that causes the GPS device 25 to run an illuminance-based automatic reception process based on the amount of light received by the solar panel 24, and a scheduled reception control unit 362 that causes the GPS device 25 to execute a scheduled automatic reception process at a set time.

The illuminance-based reception control unit 361 stops the reception process when a GPS satellite 10 is not locked within a first locking time in a first locking process, and the scheduled reception control unit 362 stops a second locking process when a GPS satellite 10 cannot be locked onto within a second locking time that is shorter than the first locking time in the second locking process.

With this configuration the scheduled automatic reception process is run by the scheduled reception control unit 362 even when sufficient light cannot be detected because the wristwatch is covered by clothing such as during the winter. A drop in the accuracy of the time displayed by the time display unit 222 can therefore be suppressed because the frequency of satellite signal reception thus increases, and the frequency of time adjustment based on the received satellite signals increases.

However, because whether the wristwatch 1 is outdoors is not determined in the scheduled automatic reception process run by the scheduled reception control unit 362, the scheduled automatic reception process could also be run when the reception environment is poor. In this case, the second locking process of the scheduled reception control unit 362 times out at a second locking time that is shorter than the first locking time in this embodiment. As a result, the second locking process can be quickly stopped when a GPS satellite 10 cannot be locked onto in the scheduled automatic reception process, and power consumption can be reduced.

The wristwatch 1 according to this embodiment of the invention can therefore conserve power while increasing the accuracy of the internal time information by improving the frequency of satellite signal reception.

In this embodiment, the reception control unit 36 can select and control operation in a first reception mode that operates only the illuminance-based reception control unit 361, and a second reception mode that operates both the illuminance-based reception control unit 361 and scheduled reception control unit 362. In the automatic reception process, the reception control unit 36 first controls operation in the first reception mode. The success rate of the reception process can be improved in this first reception mode because the reception process is executed only when a specific illuminance is detected, that is, only when the timepiece is determined to be outdoors. Power consumption can be suppressed in this case because wasteful reception processes, such as reception processes when indoors, are not executed.

However, if the reception process is not executed in the first reception mode on day 1, the reception control unit 36 switches to the second reception mode. The frequency of reception can therefore be improved even when the specific illuminance is not detected because the scheduled automatic reception process based on a set time is executed on day 2.

In this embodiment the reception control unit 36 runs the scheduled automatic reception process during control in the second reception mode, and when locking fails in the second locking process, controls operation in the second reception mode.

The scheduled reception control unit 362 causes the second locking process to time out at a second locking time that is shorter than the first locking time. Power consumption in the second locking process is therefore less than in the first locking process, and the second reception mode can be continued. In addition, because the frequency of satellite signal reception can be increased by continuing control in the second reception mode, the accuracy of the time displayed by the display device 22 can also be increased.

When the locking failure count stored in the locking result memory 264 equals or exceeds a specific threshold, the reception control unit 36 in this embodiment switches control to the first reception mode.

When locking failures continue in the second locking process of the scheduled automatic reception process performed at a set time, the electronic timepiece is often not outdoors at the set time. If the scheduled automatic reception process continues to be executed at the set time in this case, the possibility of the second locking process failing again is strong, and power consumption increases.

However, by switching to the first reception mode when the number of consecutive failures in the second locking process exceeds a specific count, the number of wasted reception processes can be reduced and power consumption can be further suppressed.

In this embodiment the reception control unit 36 sets the start time of the next automatic reception process when the illuminance-based automatic reception process is executed and when the second reception process is executed in the scheduled automatic reception process. In this case, the reception control unit 36 sets the start time of the next automatic reception process to 00:00:00 a.m. the next day if the battery 23 voltage detected by the battery voltage detection unit 34 is 3.9 V or greater, and if the voltage is less than 3.9 V, the reception control unit 36 sets the start time of the next automatic reception process to 00:00:00 a.m. three days later, for example, and sets a reception delay period of two days.

Because power consumption is high in reception processes other than the second locking process (during the illuminance-based automatic reception process and the second reception process of the scheduled automatic reception process), a system shutdown could occur if the reception process is performed when the battery 23 voltage is low. However, by setting a rest (reception delay) period, power consumption can be suppressed during the rest period. The battery voltage can also be increased by charging the battery 23 during this time.

When the illuminance-based automatic reception process succeeds in this embodiment, the time scheduling unit 32 sets and stores the time the reception process executed as the set time in the set time memory 263.

The times when the user is outdoors, such as when commuting or going to lunch, are generally determined by the user's daily schedule. Therefore, by setting the time when the illuminance-based automatic reception process succeeds as the set time for scheduled reception, the time when the user is normally outdoors can be set as the scheduled reception time. By running the scheduled automatic reception process based on this set time, the likelihood that the scheduled automatic reception process will be performed when outdoors is increased, and the probability that the satellite signal can be received can be improved.

In this embodiment, the scheduled reception control unit 362 references the date and time of the last illuminance-based automatic reception process stored in the illuminance-based reception date/time memory 265, and switches to the first reception mode if the date/time of the internal time information is a date/time greater than the reception-enabled period after the date/time stored in the illuminance-based reception date/time memory 265.

If the illuminance-based automatic reception process, which is executed when illuminance equal to or exceeding a specific illuminance level is detected, is not executed for the reception-enabled period or longer, the wristwatch 1 has probably been left indoors for a long time. In this case, the scheduled reception control unit 362 in this embodiment determines that the date/time of the internal time information is at least the reception-enabled period past the date/time stored in the illuminance-based reception date/time memory 265, and does not execute the scheduled automatic reception process. As a result, the scheduled automatic reception process is not executed indoors where the reception environment is poor, power consumption by this process can be eliminated, and energy conservation can be improved.

In the first reception process in this embodiment the illuminance-based reception control unit 361 monitors the signal level of the satellite signal detected by the level detection unit 35, and stops the first reception process if the signal level is less than a preset threshold level. The scheduled reception control unit 362 likewise monitors the signal level of the satellite signal detected by the level detection unit 35 in the second reception process, and stops the second reception process if the signal level is less than a preset level.

Power consumption increases if the reception process continues in the first reception process or second reception process when the user wearing the wristwatch 1 moves indoors or into a tunnel or other place where the satellite signal reception environment is poor. By stopping the reception process in the first reception process or second reception process when the satellite signal level is less than a threshold level, however, this embodiment can suppress an increase in power consumption.

Embodiment 2

A second embodiment of the invention is described next with reference to the accompanying figures.

In the first embodiment the scheduled reception control unit 362 times out in the second locking process at a fixed second locking time. This second embodiment differs from the first embodiment in that the second locking time changes according to the battery 23 voltage.

Note that the wristwatch according to the second embodiment has the same configuration as the wristwatch 1 according to the first embodiment of the invention shown in FIG. 1 to FIG. 4. Further detailed description of parts other than the scheduled reception control unit 362 is therefore omitted.

In the second locking process of the scheduled automatic reception process, the scheduled reception control unit 362 of the second embodiment changes the time (second locking time) until the second locking process times out according to the voltage of the battery 23 detected by the battery voltage detection unit 34.

More specifically, the scheduled reception control unit 362 sets the second locking time to 5 seconds, for example, when the battery 23 voltage is 3.9 V or greater as in the first embodiment. However, when the battery 23 voltage is less than 3.9 V, the scheduled reception control unit 362 sets the second locking time until operation times out to a shorter time (such as 4 seconds) than when the battery 23 voltage is 3.9 V or greater.

Note that this embodiment is described as setting the second locking time to 5 seconds or 4 seconds according to the battery 23 voltage, but the invention is not so limited. For example, when the battery 23 voltage is less than 3.9 V, the scheduled reception control unit 362 could change the time in finer increments according to the battery voltage.

The scheduled automatic reception process executed under the control of the scheduled reception control unit 362 is described next based on FIG. 8.

Figure 8:
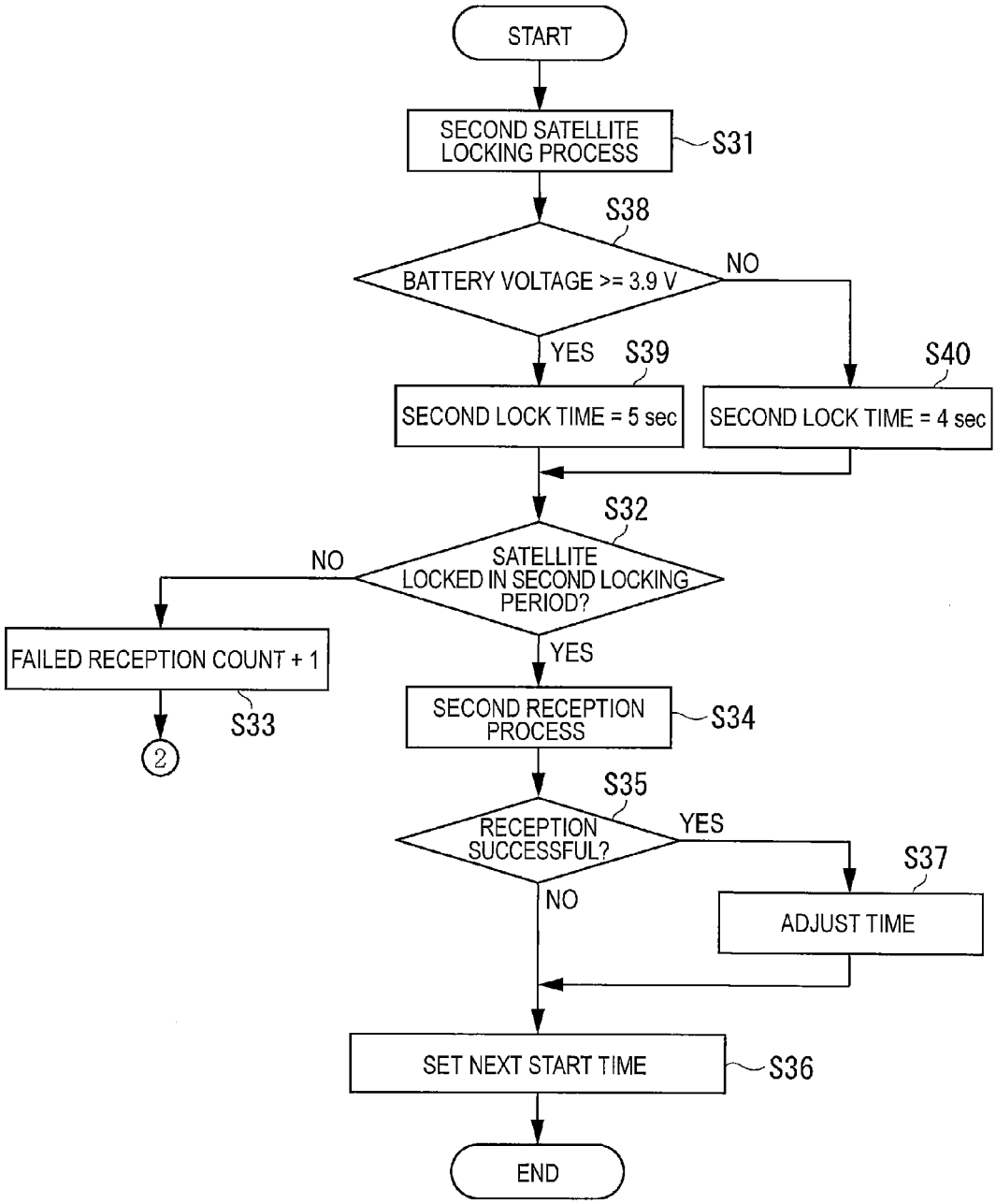
FIG. 8 is a flow chart of the scheduled automatic reception process in a wristwatch according to a second embodiment of the invention.

FIG. 8 is a flow chart of the scheduled automatic reception process in this second embodiment. Note that identical steps in FIG. 8 and FIG. 7 are identified by the same reference numerals, and further description thereof is omitted.

When the second locking process executes in step S31 in the scheduled automatic reception process according to the second embodiment of the invention as shown in FIG. 8, the scheduled reception control unit 362 checks the voltage of the battery 23 detected by the battery voltage detection unit 34 and determines if the voltage is 3.9 V or more (S38).

If S38 returns Yes, the scheduled reception control unit 362 sets the second locking time to 5 seconds (S39), and sets the second locking time to 4 seconds (S40) if S38 returns No.

The scheduled reception control unit 362 then executes S32 as in the first embodiment. In this case, however, the scheduled reception control unit 362 determines if a GPS satellite 10 was locked onto in the second locking time set in S39 or S40.

If S32 returns Yes, the scheduled reception control unit 362 executes the second reception process in S33. If S32 returns No, the scheduled reception control unit 362 adds 1 to the locking failure count (S33), and returns to the process in FIG. 5. More specifically, if the scheduled automatic reception process fails at the set time for that day and the locking failure count is less than the specified count, the wristwatch 1 continues control in the second reception mode that operates both the illuminance-based reception control unit 361 and scheduled reception control unit 362 as in the first embodiment.

Effect of Embodiment 2

In the second embodiment the scheduled reception control unit 362 watches the battery 23 voltage detected by the battery voltage detection unit 34, and when the voltage is 3.9 V or greater, runs the second locking process using a second locking time of 5 seconds. However, when the voltage is less than 3.9 V, the scheduled reception control unit 362 runs the second locking process using a shorter second locking time of 4 seconds.

Power consumption by the GPS device 25 is high compared with other parts of the wristwatch 1, and if the second locking process of the GPS device 25 is run for a long time when the remaining battery 23 power is low, the system could shut down and displaying the time on the time display unit 222 may not be possible. By setting the second locking time until a timeout occurs in the second locking process according to the battery 23 voltage, and shortening the second locking time as the battery voltage drops, this embodiment reduces power consumption and suppresses system shutdowns and other problems.

Other Variations

The invention is obviously not limited to the embodiments described above.

For example, the scheduled reception control unit 362 could run a positioning information satellite locking process before or after the set time.

More specifically, in addition to the set time, the scheduled reception control unit 362 executes the positioning information satellite locking process at a specific time before (such as 10 minutes before) the set time or a specific time after (such as 10 minutes after) the set time. The positioning information satellite locking time in this case may be set to a third locking time (such as 4 seconds) that is shorter than the second locking time (such as 5 seconds) of the scheduled automatic reception process performed at the set time.

If a positioning information satellite lock is made at the specific time before the set time, the scheduled reception control unit 362 completes the satellite signal reception process. In this case, the reception process is not executed at the following set time or the specific time after the set time. The reception process is also not performed at the specific time after the set time when the satellite signal is received in the scheduled automatic reception process at the set time. The positioning information satellite locking process is therefore performed after the set time only when a positioning information satellite lock is not made at the specific time before the set time or at the set time.

This embodiment increases the possibility of receiving a satellite signal when the electronic timepiece is not outdoors at the set time because of slight variations in the daily schedule of the user because the positioning information satellite locking process is performed for a short time (third locking time) before or after the set time. Power consumption can also be suppressed because the third locking time, which is the timeout time of the locking processes before and after the set time, is set to a shorter time than the second locking time.

The foregoing embodiments describe stopping reception in the first reception process and second reception process when the satellite signal level detected by the level detection unit 35 is less than a specific threshold, but the invention is not so limited. For example, the first reception process and second reception process may continue even when the signal level is less than the specific threshold. This enables continuing the first reception process or second reception process when the reception environment will improve in a short time, such as when the user wearing the wristwatch 1 has entered a tunnel or is between buildings.

A process that measures the length of time the signal level is below the threshold, and stops the reception process when this time exceeds a specific threshold, is also conceivable.

The foregoing embodiments do not run the scheduled automatic reception process controlled by the scheduled reception control unit 362 once the reception-enabled period following the date/time stored in the illuminance-based reception date/time memory 265 has past, but the invention is not so limited. For example, the scheduled automatic reception process could be executed continuously without setting a reception-enabled period. More specifically, even when the wristwatch 1 is left indoors and the illuminance-based automatic reception process does not execute, locking onto a GPS satellite 10 and receiving the satellite signal may be possible depending on the specific location. If the scheduled reception control unit 362 runs the scheduled automatic reception process in this case, the internal time information can be kept to an extremely accurate time. Adjusting the time the next time the user uses the wristwatch 1 is therefore not necessary, and wristwatch 1 convenience can be improved.

A process that also stops the illuminance-based automatic reception process controlled by the illuminance-based reception control unit 361 once the reception-enabled period following the date/time stored in the illuminance-based reception date/time memory 265 has past is also conceivable, and increased power consumption can be further suppressed in this case.

The time scheduling unit 32 sets the time when the illuminance-based automatic reception process succeeds as the set time above, but the set time could be manually set by the user.

When the number of times (number of days) the second locking process fails consecutively in the scheduled automatic reception process equals or exceeds a specific count (specific number of days), the embodiments described above stop the scheduled reception control unit 362 and stop the scheduled automatic reception process, and use only the illuminance-based automatic reception process controlled by the illuminance-based reception control unit 361, but the invention is not so limited. For example, a configuration that executes the scheduled automatic reception process even when the number of times (number of days) the second locking process fails consecutively equals or exceeds the specific count is also conceivable.

The reception control unit 36 switches to the second reception mode when the reception process is not executed in the first reception mode above, but could control the automatic reception process only in the second reception mode.

Power consumption can also be suppressed in this case by the second locking process of the scheduled automatic reception process timing out at a second locking time that is shorter than the first locking time.

The foregoing embodiments are described with a solar panel 24 having a power generating function as the illuminance detection unit, but a light sensor without a power generating function could obviously be used instead.

The foregoing embodiments are described with reference to a GPS satellite as an example of a positioning information satellite, but the positioning information satellite of the invention is not limited to GPS satellites and the invention can be used with Global Navigation Satellite Systems (GNSS) such as Galileo (EU), GLONASS (Russia), and Beidou (China), and other positioning information satellites that transmit satellite signals containing time information, including the SBAS and other geostationary or quasi-zenith satellites.

The electronic timepiece according to the invention is not limited to analog timepieces having hands, and can also be applied to hybrid timepieces having both analog hands and a digital display, and to digital timepieces having only a digital display. The invention is also not limited to wristwatches, and can be adapted to pocket watches and other types of mobile timepieces, and electronic devices including cellular telephones, digital cameras, personal navigation devices, motor vehicle navigation devices, and other types of mobile information terminals having the electronic timepiece of the invention.

Although the present invention has been described in connection with the preferred embodiments thereof with reference to the accompanying drawings, it is to be noted that various changes and modifications will be apparent to those skilled in the art. Such changes and modifications are to be understood as included within the scope of the present invention as defined by the appended claims, unless they depart therefrom.

What is claimed is:

1. An electronic timepiece comprising:

a reception unit that locks onto a positioning information satellite and receives satellite signals from the locked positioning information satellite;

a time adjustment unit that adjusts internal time information based on the satellite signal received by the reception unit;

a time display unit that displays the internal time information;

an illuminance detection unit that detects illuminance; and a reception control unit that controls the reception unit, and includes an illuminance-based reception control unit that controls the reception unit and executes a satellite signal reception process when the illuminance detected by the illuminance detection unit equals or exceeds a specific illuminance threshold, and a scheduled reception control unit that controls the reception unit and executes a satellite signal reception process when the internal time information reaches a preset set time;

wherein the illuminance-based reception control unit stops the reception process when a positioning information satellite cannot be locked onto within a first locking time when the reception unit is controlled and the reception process started, and the scheduled reception control unit stops the reception process when a positioning information satellite cannot be locked onto within a second locking time that is shorter than the first locking time when the reception unit is controlled and the reception process started.

2. The electronic timepiece described in claim 1, wherein:

the reception control unit can select a first reception mode that operates the illuminance-based reception control unit and stops the scheduled reception control unit, and a second reception mode that operates the illuminance-based reception control unit and the scheduled reception control unit, switches control to the second reception mode when the reception process is not started within a specific time after starting control in the first reception mode, and stops the scheduled reception control unit when the reception process is started by the illuminance-based reception control unit after control is started in the second reception mode.

3. The electronic timepiece described in claim 2, wherein:

the reception control unit continues control in the second reception mode when the reception process by the scheduled reception control unit is started after control starts in the second reception mode and the reception process is then stopped because a positioning information satellite cannot be locked onto within the second locking time.

4. The electronic timepiece described in claim 2, wherein:

the reception control unit switches control to the first reception mode when the process that stops the reception process because a positioning information satellite cannot be locked onto within the second locking time is consecutively executed at least a specific number of times.

5. The electronic timepiece described in claim 2, further comprising:

a battery that supplies power to drive the electronic timepiece; and a voltage detection unit that detects the battery voltage;

wherein when the reception process is executed by the illuminance-based reception control unit during control in the first reception mode, when the reception process is executed by the illuminance-based reception control unit during control in the second reception mode, and when the reception process is started by the scheduled reception control unit and the positioning information satellite is locked within the second locking time during control in the second reception mode, the reception control unit detects the battery voltage with the voltage detection unit, delays reception control for a set rest period when the detected voltage is less than a specific threshold, and controls operation in the first reception mode without delaying reception control when the detected voltage is greater than or equal to the specific threshold.

6. The electronic timepiece described in claim 1, further comprising:

a battery that supplies power to drive the electronic timepiece; and a voltage detection unit that detects the battery voltage;

wherein the scheduled reception control unit sets the second locking time according to the voltage detected by the voltage detection unit.

7. The electronic timepiece described in claim 1, further comprising:

a scheduled time setting unit that sets the set time, and sets the time that the reception process of the illuminance-based reception control unit succeeded as the set time.

8. The electronic timepiece described in claim 1, wherein:

the scheduled reception control unit controls the reception unit and executes the positioning information satellite locking process at least one of a specific time before the set time and a specific time after the set time, stops the locking process when a positioning information satellite cannot be locked onto during the locking process within a third locking time that is shorter than the second locking time, and receives the satellite signal from the locked positioning information satellite when a positioning information satellite can be locked onto during the locking process.

9. The electronic timepiece described in claim 1, further comprising:

an illuminance-based reception date/time memory that stores the date and time the reception process is executed by the illuminance-based reception control unit;

wherein the reception control unit stops the scheduled reception control unit when the date and time of the internal time information is a date and time that is at least a preset reception-enabled period past the date and time stored in the illuminance-based reception date/time memory.

10. The electronic timepiece described in claim 1, further comprising:

a level detection unit that detects the signal level of the satellite signal received by the reception unit;

wherein the illuminance-based reception control unit and the scheduled reception control unit stop the reception process when the signal level detected by the level detection unit goes below a specific threshold level during the reception process.

* * * * *